TEMPERATURE COMPENSATED INTERNAL COMBUSTION ENGINE IGNITION SPARK VACUUM ADVANCE SYSTEM

This invention relates to an internal combustion engine ignition spark vacuum advance system and, more specifically, to a temperature compensated internal combustion engine ignition spark vacuum advance system.

With prior art internal combustion engine ignition spark vacuum advance systems, the ignition distributor spark initiating mechanism is operated to vary ignition spark advance by the operating rod of a conventional vacuum actuator unit of the type which provides ignition spark vacuum advance within a single preselected range regardless of ambient temperature. As is well known in the automotive art, an internal combustion engine should be provided with a greater ignition spark vacuum advance range during cold weather operation. Therefore, the provision of a temperature compensated internal combustion engine ignition spark vacuum advance system which provides a selected range of ignition spark vacuum advance for warm weather operation and a greater range of ignition spark vacuum advance for cold weather operation is desirable.

It is, therefore, an object of this invention to provide an improved internal combustion engine ignition spark vacuum advance system.

It is another object of this invention to provide an improved internal combustion engine ignition spark vacuum advance system which is temperature compensated.

It is a further object of this invention to provide an improved internal combustion engine ignition spark vacuum advance system which is temperature compensated to provide a first predetermined range of ignition spark vacuum advance for warm weather operation and a second greater predetermined ignition spark vacuum advance range for cold weather operation.

In accordance with this invention, an improved internal combustion engine ignition spark vacuum advance system is provided wherein an ambient temperature sensing valving arrangement is provided for an exhaust port opening into the vacuum chamber of a vacuum actuator unit for providing a first predetermined range of ignition spark vacuum advance for warm weather operation and a second greater predetermined range of ignition spark vacuum advance for cold weather operation.

For a better understanding of the present invention, together with additional objects, advantages and features thereof, reference is made to the following description and accompanying drawings in which.

In FIGS. 1 through 6, inclusive, of the drawings, like elements have been assigned like characters of reference.

Figure 5:
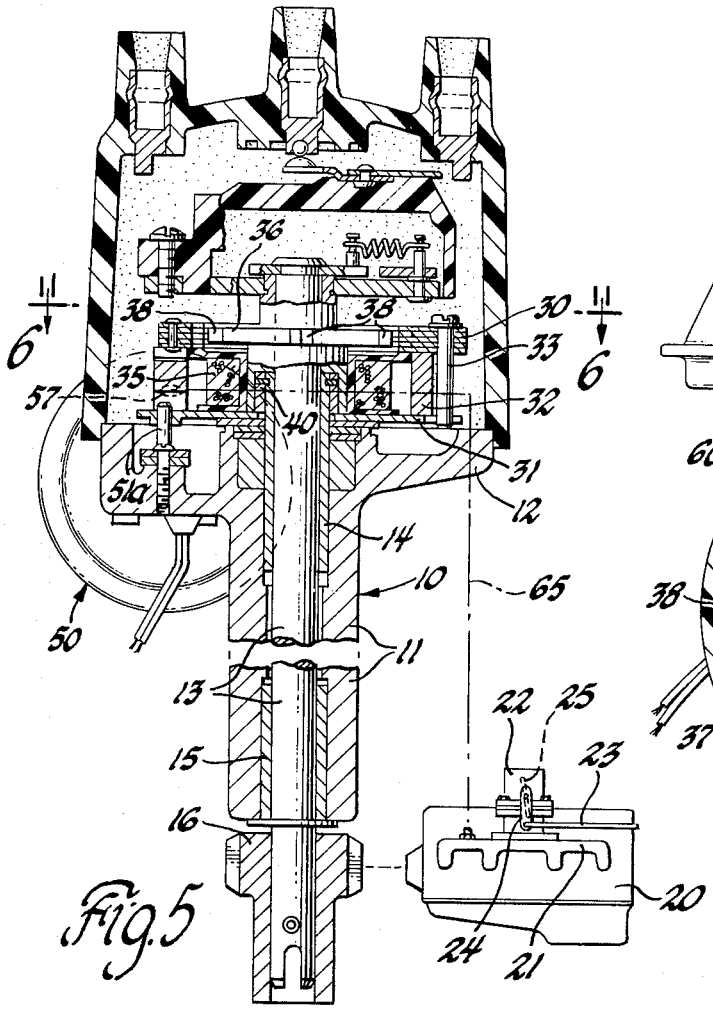
FIG. 5 is an elevation view in cross-section of an internal combustion engine ignition distributor including the vacuum actuator unit of FIG. 1.
Figure 6:
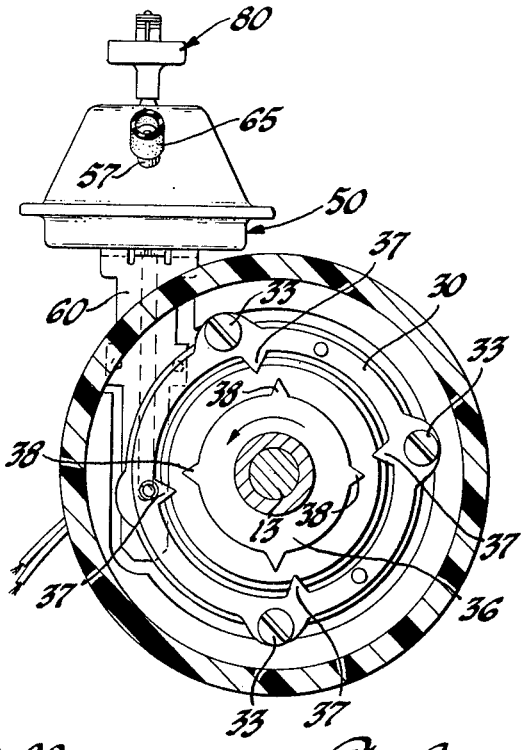
FIG. 6 is a top section view of FIG. 5 taken along line 6—6 and looking in the direction of the arrows.

In the interest of reducing drawing complexity, certain parts of the ignition distributor of FIGS. 5 and 6 which are not associated with the ignition spark vacuum advance system of this invention have not been illustrated.

The operation of the temperature compensated internal combustion engine ignition spark vacuum advance system of this invention is described in this specification with regard to a modern internal combustion engine ignition distributor of a magnetic pickup type. It is to be specifically understood, however, that this system is equally suitable for use with ignition distributors of the type having ignition distributor breaker contacts or contact sets mounted upon the rotatable breaker plate of the type well known in the prior automotive art. It is only necessary that the ignition spark initiating mechanism for initiating the generation of ignition spark potential for each cylinder of and in timed relationship with the engine be of the type which is operable to vary the time each ignition spark potential is initiated.

Referring to FIG. 5 of the drawing, the reference numeral 10 designates the ignition distributor base which includes a tubular portion 11 and an annular portion 12. A shaft member 13 is journaled by a pair of sleeve type bearing bushings 14 and 15 which are fitted within enlarged bores formed in tubular portion 11. The shaft member 13 is rotated in timed relationship with an associated internal combustion engine 20 through gear 16 which is arranged to be in meshing engagement with a suitable corresponding gear in the associated internal combustion engine 10, as is well known in the automotive and internal combustion engine art.

Internal combustion engine 20 is equipped with an intake manifold 21 and a carburetor 22 mounted upon intake manifold 21 in a conventional manner. A throttle lever 23, which may be foot operated by the operator within the passenger compartment in a manner well known in the automotive art, is secured through a link 24 to throttle valve 25 of carburetor 22. In FIG. 5, throttle valve 25 is shown to be in full open throttle position. In this position, the engine intake manifold is at substantially atmospheric pressure. To decelerate the engine, pressure is released from throttle lever 23 which permits link member 24 to rotate in a counterclockwise direction , as viewing FIG. 5, to close throttle valve 25. The closing of throttle valve 25 results in an increase of intake manifold or engine vacuum as throttle valve 25 approaches the full closed position. With engine idle conditions, intake manifold or engine vacuum may be of the order of 13 to 15 inches of mercury.

A magnetic pickup assembly and rotor located within annular portion 12 of distributor base 10 produce the ignition signal potential pulses which initiate the generation of an ignition spark potential for each cylinder of engine 20. The magnetic pickup assembly includes a pole piece 30 of magnetic material, an annular timing plate 31 of a magnetic material, an annular permanent magnet 32 which is clamped between pole piece 30 and timing plate 31 by a plurality of fastening devices 33 and a pickup coil 35. Pole piece 30 may be made up of cally understood that alternative methods of operatively engaging operating rod 51 with diaphragm member 53 may be employed without departing from the spirit of the invention, it being only necessary that operating rod 51 be operated in a linear direction along the longitudinal axis of diaphragm 53.

Vacuum chamber 56 is in vacuum communication with intake manifold 21 of engine 20 through vacuum port 57 and vacuum line 65. Intake manifold or engine vacuum, therefore, is exposed to diaphragm member 53 and chamber 54 is at atmospheric pressure.

As rotor member 36 is rotated in a counterclockwise direction, as illustrated by the arrow of FIG. 6, changes of intake manifold or engine vacuum which produce a clockwise rotation of a magnetic pickup assembly result in the production of ignition signal potential pulses and, consequently, the initiating of ignition spark potentials at times earlier relative to engine crankshaft position and changes of intake manifold or engine vacuum which produce a counterclockwise rotation of the magnetic pickup assembly result in the production of ignition signal potential pulses and, consequently, the initiation of ignition spark potentials at times later relative to engine crankshaft position.

Figure 1:
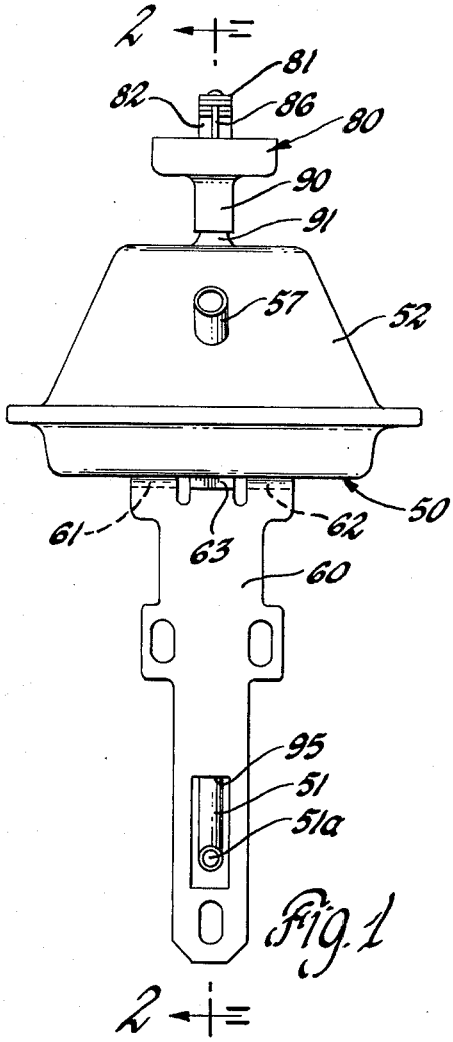
FIG. 1 is a top view of a vacuum actuator unit suitable for use with the temperature compensated internal combustion engine ignition spark vacuum advance system of this invention.
Figure 2:
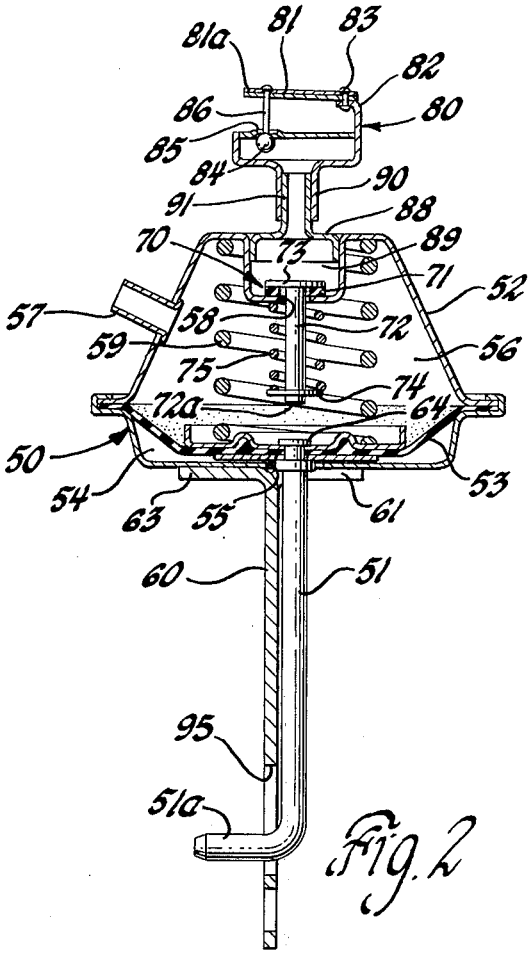
FIG. 2 is a section view of FIG. 1 taken along line 2—2 and looking in the direction of the arrows.
Figure 3:
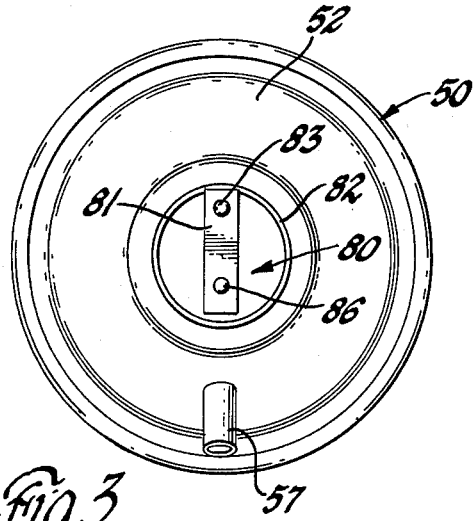
FIG. 3 is an end view of the vacuum actuator unit of FIG. 1 as looking at the vacuum chamber end thereof.
Figure 4:
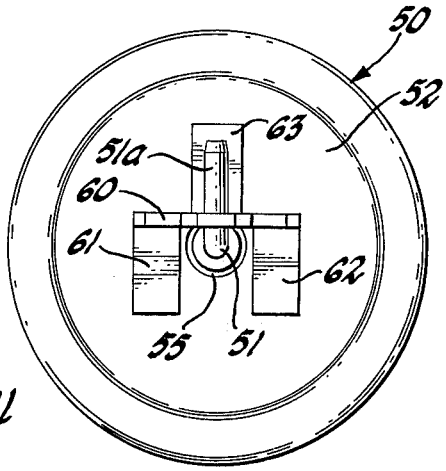
FIG. 4 is an end view of the opposite end of the vacuum actuator unit of FIG. 1.

Normally closed valve 70 for exhaust port 58 is arranged to be operated to the open position by the force produced by diaphragm member 53 flexing in a direction to produce increased ignition spark vacuum advance. In the preferred embodiment as illustrated in FIG. 2, a sealing ring 71 of a resilient material such as rubber or neoprene surrounds exhaust port 58 on the side thereof opposite vacuum chamber 66. Extending through exhaust port 58 is a plunger member 72 having secured to the end thereof extending through exhaust port 58 a header disc member 73 of a diameter selected to accommodate sealing ring 71 in a manner well known in the art. A retaining ring 74 is secured to the opposite end of plunger 72 and a helical compression spring 75 is retained between retainer ring 74 and the interior surface of the end wall of outer casing 52 whereby plunger member 72 is forced thereby in a direction toward operating rod 51. Consequently, disc member 73 is normally maintained in sealing fit with sealing ring 71.

A temperature sensitive valve, generally illustrated at 80 is illustrated between the normally closed valve 70 and atmosphere and is of the type which automatically operates to the closed position with ambient temperatures less than a predetermined value and to the open position with ambient temperatures greater than the predetermined value. One example and without intention or inference of a limitation thereto of a valve of this type may be of the bimetal strip actuator type. A bimetal strip 81 is rigidly secured to wall member 82 of switch 80 by a rivet 83, the end 81a thereof being free to move in a vertical direction as viewing FIG. 2. A ball check 84 arranged to seat in orifice 85 with a tight sealing fit is rigidly secured to the end **81*a* of bimetallic strip 81 through offset rivet 86. Bimetal strip 81 is so oriented that with an increase of ambient temperature, end 81*a* thereof moves in the direction which will displace ball check 84 out of tight sealing fit engagement with orifice 85 and with a decrease of ambient temperature, end 81*a* thereof moves in the direction which will place ball check 84 in tight sealing fit engagement with orifice 85. With this arrangement, therefore, temperature sensitive valve 80** automatically operates to the closed position with ambient temperatures less than a predetermined value and to the open position with ambient temperatures greater than the predetermined value.

A sealing thimble 88 is arranged to fit within the cylindrical side walls of the cuplike depression 89 extending into vacuum chamber 56 and the collar portion 90 of valve 80 is arranged to fit extension 91 of thimble 88 in tight sealing fit engagement.

It is to be specifically understood that the valving arrangement illustrated in FIG. 2, both the normally open valve 70 and the temperature sensitive valve 80 are illustrative only of a suitable valving arrangement. Other valving arrangements which provide the same function may be employed without departing from the spirit of the invention.

Figure 7:
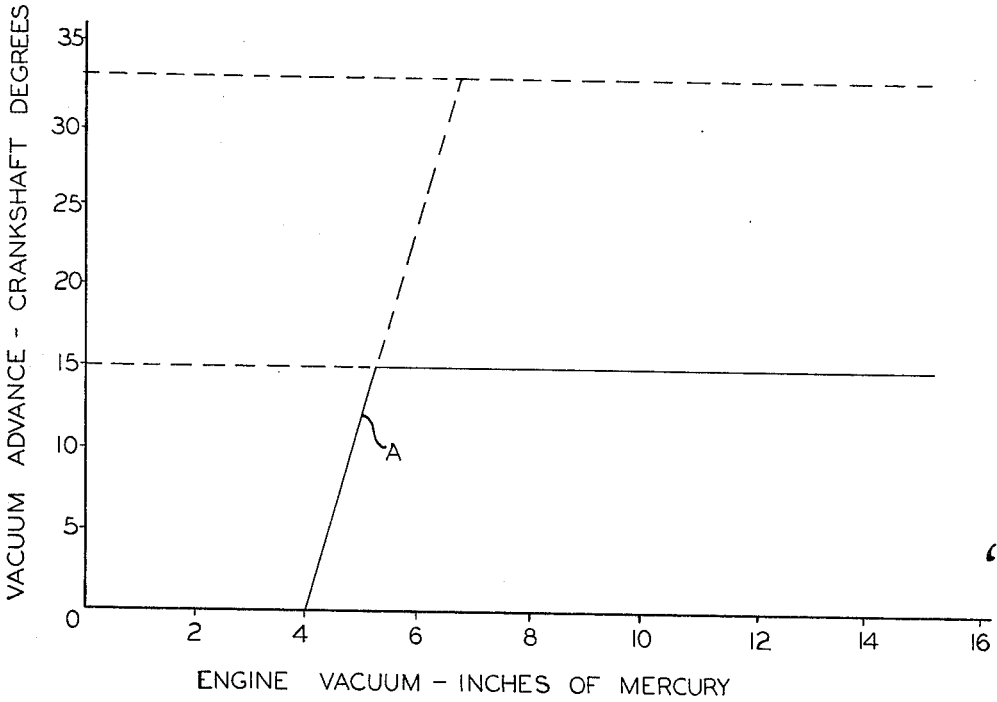
FIG. 7 illustrates the two predetermined ranges of ignition spark vacuum advance provided by the temperature compensated ignition spark vacuum advance system of this invention.

For the purpose of clearly describing the operation of the novel temperature compensated internal combustion engine ignition spark vacuum advance system of this invention, it will be assumed that the ignition spark vacuum advance for internal combustion engine 20 is initiated at four inches of mercury intake manifold vacuum and increases linearly to a maximum of 15 engine crankshaft degrees vacuum advance at 5 inches of mercury engine intake manifold vacuum for warm weather operation and to a maximum of 33 engine crankshaft degrees vacuum advance at 6 inches of mercury engine intake manifold vacuum for cold weather operation, as illustrated in FIG. 7. The space between rivet 64 and the end **72*a* of plunger 70 is selected to be equal to the distance operating rod 51** must travel to rotate the ignition spark advance initiating mechanism of the distributor an amount equal to 15° ignition spark vacuum advance.

Temperature sensitive valve 80 is illustrated in the drawing as being mounted directly upon vacuum actuator unit 50. It is to be specifically understood that temperature sensitive valve 80 may be mounted at any location at which it is exposed to the ambient temperature in which the engine is operating such as the carburetor intake air cleaner. If temperature sensitive valve 80 is mounted remote from vacuum actuator unit 50, it may be connected to sleeve 91 of thimble 88 through a vacuum line in a manner well known in the art.

While engine 20 is operating in an ambient temperature greater than a predetermined value, such as 40° F., bimetal strip 81 of temperature sensitive valve 80 moves ball check 84 out of tight sealing fit engagement with orifice 85. As the engine intake manifold vacuum increases to five inches of mercury, the ignition spark vacuum advance increases substantially linearly along line A of FIG. 7 to the 15 engine crankshaft degrees ignition spark vacuum advance point. At this time, rivet 64 engages end **72*a* of plunger 72 to move circular disc 73 out of sealing engagement with sealing ring 71 to operate normally closed valve 70 to the open position. With normally closed valve 70 operated to the open position while temperature sensitive valve 80 is in the open position, vacuum chamber 56** is exposed to atmosphere, a condition which produces a maximum of 15 engine crankshaft degrees ignition spark vacuum advance.

While engine 20 is operating in ambient temperature conditions less than the predetermined value such as 40° F., bimetal strip 81 of temperature sensitive valve 80 moves ball check 84 into tight sealing fit engagement with orifice 85. As the engine intake manifold vacuum increases, the ignition spark vacuum advance increases along line A of FIG. 7 to the 15 engine crankshaft degrees ignition spark vacuum advance point. At this point rivet 64 engages end 72*a* of plunger 72 to operate normally closed valve 70 to the open position. However, since temperature sensitive valve 80 is in the closed position, vacuum chamber 56 is not exposed to atmosphere, consequently, the ignition spark vacuum advance continues to increase to the 33 engine crankshaft degrees ignition spark vacuum advance point. At this time, turned up portion 51*a* of operating rod 51 is arranged to engage shoulder 95 of a slot in mounting bracket 60 which is so positioned to provide a maximum ignition spark advance of 33 engine crankshaft degrees. Consequently, with cold weather operation, the ignition spark vacuum advance increases substantially linearly to 33 engine crankshaft degrees between 4 and 6 inches of mercury engine manifold vacuum and is maintained at a maximum of 33 engine crankshaft degrees for all values of engine vacuum greater than 6 inches of mercury.

From this description, it is apparent that the temperature compensated internal combustion engine ignition spark vacuum advance system of this invention provides a selected range of ignition spark vacuum advance for warm weather operation and a greater range of ignition spark vacuum advance for cold weather operation.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. A temperature compensated internal combustion engine ignition spark vacuum advance system for varying the time an ignition spark potential is generated for each cylinder of and associated internal combustion engine in response to engine vacuum, comprising in combination; an ignition spark initiating mechanism for initiating the generation of an ignition spark potential for each cylinder of and in timed relationship with said engine of the type operable to vary the time each ignition spark potential is initiated and a vacuum actuator unit having an operating rod in operating engagement with said spark initiating mechanism, said vacuum actuator unit having an outer casing defining an enclosed space, a flexible diaphragm member in operating engagement with said operating rod and having opposite flat face surfaces located within said enclosed space and so positioned that it divides said enclosed space into a first chamber exposed to atmosphere and a second vacuum chamber, a vacuum port for said vacuum chamber in communication with engine vacuum, an exhaust port for said vacuum chamber and a dual valve arrangement for said exhaust port including a first normally closed valve operable to the open position when engine vacuum is greater than a predetermined number of inches of mercury and a second temperature sensitive valve located between said first normally closed valve and atmosphere of the type which automatically operates to the closed position with ambient temperatures less than a predetermined value and to the open position with ambient temperatures greater than said predetermined value.

2. A temperature compensated internal combustion engine ignition spark vacuum advance system for varying the time an ignition spark potential is generated for each cylinder of an associated internal combustion engine in response to engine vacuum, comprising in combination; an ignition spark initiating mechanism for initiating the generation of an ignition spark potential for each cylinder of and in timed relationship with said engine of the type operable to vary the time each ignition spark potential is initiated and a vacuum actuator unit having an operating rod in operating engagement with said ignition spark timing mechanism, said vacuum actuator unit having an outer casing defining an enclosed space, a flexible diaphragm member in operating engagement with said operating rod and having opposite flat face surfaces located within said enclosed space and so positioned that it divides said enclosed space into a first chamber exposed to atmosphere and a second vacuum chamber, a vacuum port for said vacuum chamber in communication with engine vacuum, an exhaust port for said vacuum chamber and a dual valve arrangement for said exhaust port including a first normally closed valve which is arranged to be operated to the open position by the force produced by said diaphragm member flexing in a direction to produce increased ignition spark vacuum advance when engine vacuum is greater than a predetermined number of inches of mercury and a second temperature sensitive valve located between said first normally closed valve and atmosphere of the type which automatically operates to the closed position with ambient temperatures less than a predetermined value and to the open position with ambient temperatures greater than said predetermined value.

* * * * *

United States Patent [19]

Sato

[11] 4,034,731

[45] July 12, 1977

[54] IGNITION SYSTEM FOR AN INTERNAL COMBUSTION ENGINE

[75] Inventor: Hiroo Sato, Susono, Japan

[73] Assignee: Kokusan Denki Co., Ltd., Numazu, Japan

[21] Appl. No.: 667,550

[22] Filed: Mar. 17, 1976

[30] Foreign Application Priority Data

Mar. 18, 1975 Japan ..... 50-32566
Mar. 20, 1975 Japan ..... 50-33656

[51] Int. Cl.[2] ..... F02P 1/00

[52] U.S. Cl. ..... 123/148 E; 123/148 CC; 315/209 SC; 310/70 A

[58] Field of Search ..... 123/148 E, 148 CC, 149 R, 123/149 A, 149 C, 149 FA; 315/209 R, 209 SC; 310/70 R, 70 A

[56] References Cited

U.S. PATENT DOCUMENTS

| | | | |
|---|---|---|---|
| 3,260,251 | 7/1966 | Lange | 123/148 E |
| 3,280,810 | 10/1966 | Worrell et al. | 123/148 E |
| 3,424,944 | 1/1969 | Nilssen | 315/209 R |

*Primary Examiner*—Ronald B. Cox
*Attorney, Agent, or Firm*—Woodling, Krost, Granger & Rust

[57] ABSTRACT

An ignition system for an internal combustion engine having an AC generator comprises an ignition coil energized by an AC output from the generator. A first thyristor is connected in series with the primary of the ignition coil and permits and interrupts the current through the primary. The first thyristor is turned on at a first angle in advance of ignition. A capacitor is charged by an AC output from the generator, and is discharged when a second thyristor conducts to apply a reverse voltage across the anode and cathode of the first thyristor. The second thyristor is triggered at a second angle.

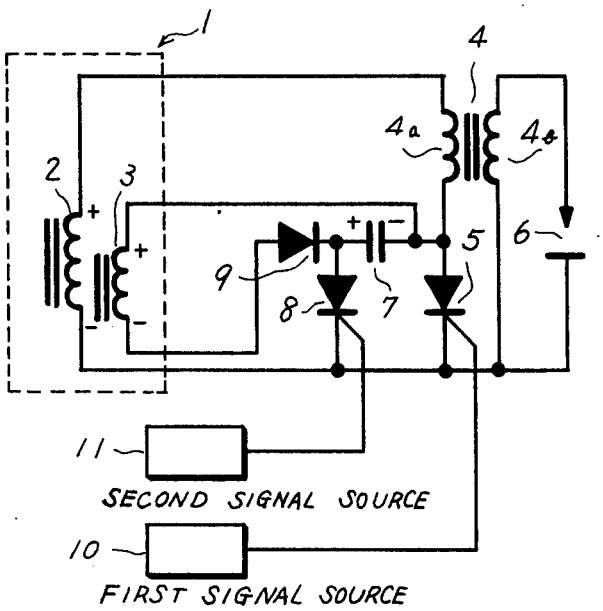

6 Claims, 22 Drawing Figures